US008640828B2

(12) United States Patent
Annen et al.

(10) Patent No.: US 8,640,828 B2
(45) Date of Patent: Feb. 4, 2014

(54) LOAD SUPPORTING BELT

(75) Inventors: Mirco Annen, Kussnacht am Rigi (CH); Stephan Jans, Kriens (CH); Hans Kocher, Udligenswil (CH)

(73) Assignee: Inventio AG, Hergiswil (CH)

( * ) Notice: Subject to any disclaimer, the term of this patent is extended or adjusted under 35 U.S.C. 154(b) by 271 days.

(21) Appl. No.: 13/130,158

(22) PCT Filed: Nov. 9, 2009

(86) PCT No.: PCT/EP2009/064812
§ 371 (c)(1),
(2), (4) Date: May 19, 2011

(87) PCT Pub. No.: WO2010/057797
PCT Pub. Date: May 27, 2010

(65) Prior Publication Data

US 2011/0220438 A1 Sep. 15, 2011

(30) Foreign Application Priority Data

Nov. 19, 2008 (EP) ..... 08169452

(51) Int. Cl.
*B66B 11/04* (2006.01)
*B66B 3/00* (2006.01)
*G08B 21/00* (2006.01)

(52) U.S. Cl.
USPC ..... 187/251; 187/391; 340/677

(58) Field of Classification Search
USPC ..... 187/251, 254, 391, 255, 413, 411; 340/677, 675, 664
IPC ..... B66B 7/12,1/34; F16G 9/04, 1/28, F16G 11/03, 11/04; D07B 1/14, 1/22
See application file for complete search history.

(56) References Cited

U.S. PATENT DOCUMENTS

| | | | | |
|---|---|---|---|---|
| 4,992,778 | A * | 2/1991 | McKeen et al. | 340/668 |
| 6,422,624 | B1 * | 7/2002 | Kauffman et al. | 294/74 |
| 7,192,185 | B2 * | 3/2007 | Lustenberger | 374/50 |
| 7,410,033 | B2 * | 8/2008 | Veronesi et al. | 187/391 |
| 7,424,996 | B2 * | 9/2008 | Larsen et al. | 254/243 |

(Continued)

FOREIGN PATENT DOCUMENTS

| | | | |
|---|---|---|---|
| EP | 0570893 | A1 | 11/1993 |
| EP | 1530040 | A1 | 5/2005 |
| EP | 1674419 | A1 | 6/2006 |
| JP | 2004067361 | A | 3/2004 |
| WO | 2005094249 | A2 | 10/2005 |
| WO | 2005095252 | A1 | 10/2005 |
| WO | 2006077092 | A1 | 7/2006 |

*Primary Examiner* — William E Dondero
*Assistant Examiner* — Minh Truong
(74) *Attorney, Agent, or Firm* — Fraser Clemens Martin & Miller LLC; William J. Clemens

(57) ABSTRACT

A supporting belt for a transport device, such as an elevator system, includes at least one stranded wire made of an electrically conducting material for absorbing the forces absorbed by the supporting belt and an electrically insulating jacket that encloses the wire. In order to determine the state of the wire, the wire can be contacted by a contact element securely and reliably and in an exact manner. To achieve this, the jacket is at least partially removed in the area of an opening of the supporting belt and the wire is at least partially exposed in the area of the opening. The wire thus does not include a jacket substantially perpendicularly to a longitudinal axis formed by a center point of a cross-section of the wire. The wire can be contacted by a contact element without the jacket being pierced.

17 Claims, 9 Drawing Sheets

(56) References Cited

U.S. PATENT DOCUMENTS

| | | | | |
|---|---|---|---|---|
| 7,670,240 | B2 * | 3/2010 | Pitts et al. | 474/237 |
| 7,681,934 | B2 * | 3/2010 | Harada et al. | 294/74 |
| 7,819,690 | B2 * | 10/2010 | Faulkner et al. | 439/397 |
| 8,011,479 | B2 * | 9/2011 | Stucky et al. | 187/393 |
| 2002/0194935 | A1 * | 12/2002 | Clarke et al. | 73/862.391 |
| 2007/0155566 | A1 * | 7/2007 | Wu | 474/263 |
| 2007/0181385 | A1 * | 8/2007 | Veronesi et al. | 187/413 |
| 2008/0190709 | A1 * | 8/2008 | Hawkes et al. | 187/392 |
| 2011/0148442 | A1 * | 6/2011 | Berner et al. | 324/691 |
| 2011/0192683 | A1 * | 8/2011 | Weinberger et al. | 187/254 |

* cited by examiner

Fig. 2
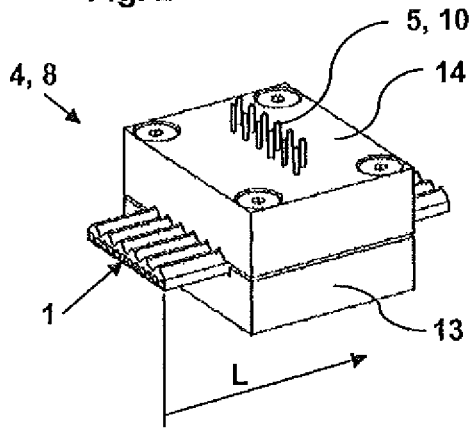
Fig. 3
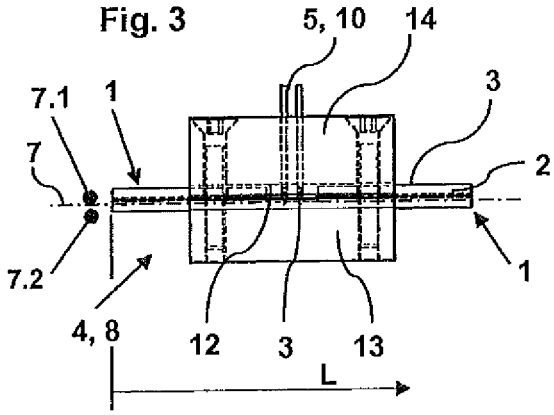
Fig. 4
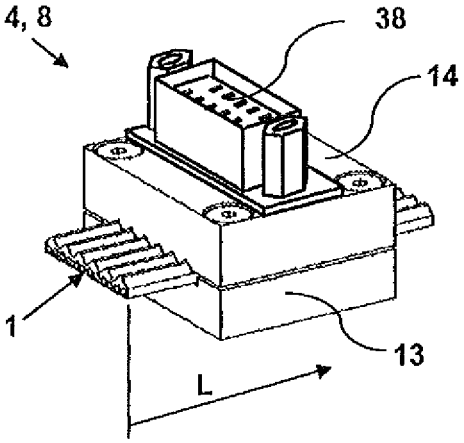
Fig. 5b
Fig. 5c
Fig. 5a
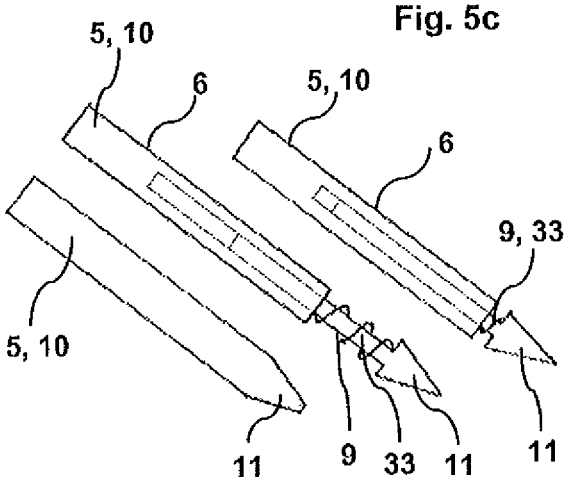

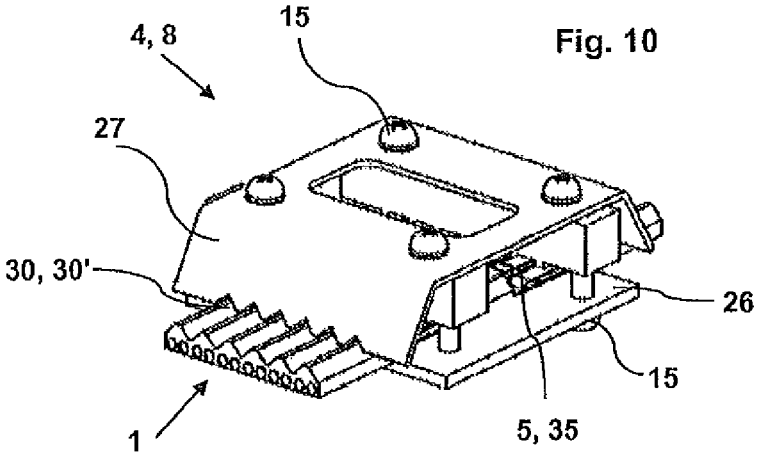
Fig. 10
Fig. 11
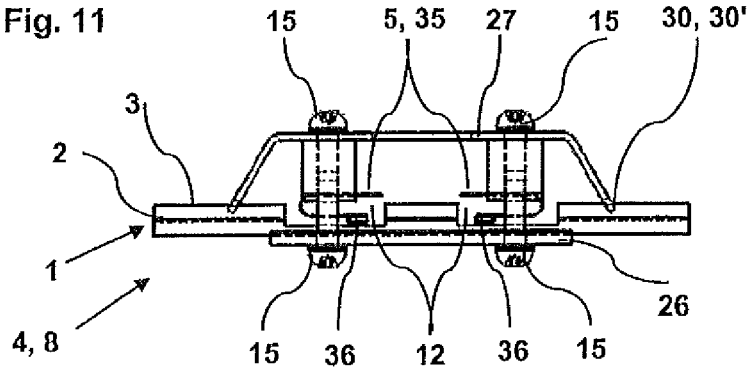
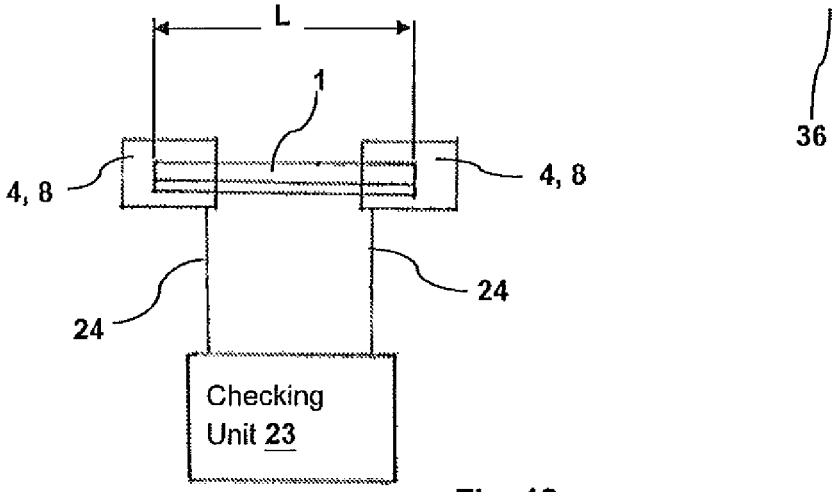
Fig. 12

LOAD SUPPORTING BELT

FIELD OF THE INVENTION

The present invention relates to a support belt, a connecting device for contacting a support belt and to a method of manufacturing a support belt. In addition, the invention relates to an elevator installation including such a load supporting belt.

BACKGROUND OF THE INVENTION

Support belts are used in conveying devices, for example elevator installations, escalators, moving walkways, hoists or cranes. The support belts generally comprise several strands which consist of steel wires and which absorb the tensile forces to be taken up by the support belt. The strands are usually enclosed by a casing of synthetic material. The casing protects the strands from, for example, mechanical wear, since the support belts are frequently guided over deflecting points, particularly rollers.

The support belts within conveying equipment are a safety-critical component, since failure or breakage thereof can lead to dropping down of the cargo. This can lead to significant damage to property and harm to persons. For this reason, use is made in conveying equipment of checking units which check, in particular, the mechanical state of the strands. Damage to the strands absorbing the forces shall thereby be capable of early recognition in order that the support belt in the case of damage can be exchanged so as to prevent failure of the conveying equipment.

The strands are surrounded by the electrically insulating casing of synthetic material. In order to carry out a check of the state of the strands, contacting of the strands by a contact element is usually required. In general, with the help of the contact a current is conducted through the strands and serves the purpose of a check current determining the state of the strands. Apart from that, other methods of checking which do not operate with electrical current, for example ultrasonic, also come into consideration.

DE 39 34 654 A1 shows a support belt according to the above-described category. The ends of the strands are in that case conductively connected in pairs with a bridge member so that the strands of the support belt are electrically connected in series. The strands of the support belt are connected with a voltage source by way of an ammeter so that the state of the strands can be checked by means of the check current conducted through all strands on the basis of the electrical connection in series.

DE 2 330 038 shows a system for contacting a flat cable. In the illustrated flat cable several strands are arranged adjacent to one another within a plane and surrounded by a casing. For electrical contacting of the strands the flat cable is clamped in place by an upper and a lower clamping member. Recesses through which insertion prongs formed at a contact carrier can be guided are arranged at the lower clamping member. The insertion prongs thereby pierce the casing of the flat cable and thus come into contact with the strands. The contacting of the strands by means of the insertion prongs is thereby carried out perpendicularly to a longitudinal axis of the strands. It is necessary in this contact-making that the insertion prongs pierce the casing of the support belt, which is disadvantageous. The piercing of the casing by the insertion prongs can, however, have the consequence that the insertion prongs during piercing of the cable depart from the intended insertion direction and as a consequence contact with the strands cannot be made. The insertion prongs can thus possibly also contact other, unintended strands or even fail to contact a strand during piercing of the casing.

WO 2005/094249 A2 and WO 20061127059 A2 show a system for contact-making with a support belt in which the contact elements initially pierce the casing of the support belt perpendicularly to a longitudinal axis of the strand and then penetrate the strands. It is disadvantageous in that case that due to the required process of piercing through the casing the contact elements can miss the strands.

WO 2005/095251 A1 shows a system for contact-making with a support belt, in which the strands are contacted by a contact element perpendicularly to a longitudinal axis of the strands. In that case the contact elements pierce the casing of the support belt. The connecting device for contacting and fixing the support belt is then also used as a load securing element.

SUMMARY OF THE INVENTION

Objects of the present invention accordingly consist of making available a support belt, a connecting device for contact-making with a support belt and a method of manufacturing a support belt as well as conveying equipment or an elevator installation, in which the strands of the support belt can be contacted securely and reliably and in precise manner by a contact element for determining the state of the strands. The support belt and the connecting device shall be simple to handle and reliable and have low production costs.

A corresponding support belt includes at least one strand of a preferably electrically conductive material, for example steel, for absorbing forces to be taken up by the support belt and a preferably electrically insulating casing which encloses the at least one strand. The support belt extends over a length which, for example is dimensioned so as to be able to connect, support and drive a car of an elevator installation with a counterweight and it has a width as considered in cross-section. The support belt has at at least one of its ends a recess which extends over the entire width and over a limited, relatively small length section of the support belt. The casing of the support belt is now removed in the region of this recess at least on one side of the support belt so that the strand or the strands is or are substantially exposed in the region of this recess. The at least one strand thus has no casing perpendicularly to a longitudinal axis formed by a center point of a cross-section of the at least one strand.

The strand consisting of metal, particularly of steel or steel wires, is enclosed by a casing of synthetic material. The strand is, in the region of the recess, freed of the casing over a part region of the sheathing so that a contact element can directly contact the strand without piercing of the casing. The strand is freed of the casing at a contact side or a first side of the support belt. Thus, perpendicularly to the axis no casing is present at the strand, but at another, second side, which is opposite the first side, of the support belt the casing still present. Advantageously, the contact element can thus be placed against the part of the strand freed from the casing (contact side) or be brought into contact with the exposed strand and on the other side the strand is still surrounded by the insulating and protective casing.

In a further embodiment, in the region of this recess the support element has in the direction of the longitudinal axis no casing, particularly only in part, between two sub-sections with a fully formed casing, or the casing of the support belt in the direction of the longitudinal axis is removed, particularly only partly, between two sub-sections with a fully formed casing. The recess is advantageously arranged in an end region or, in particular, at each of the two ends of the support belt. Substantially the entire support belt length can thus be checked.

In a further embodiment the recess, at which the casing is partly removed, is arranged at an end of the support belt or at each of the two ends of the support means.

In particular, the support belt has in the region of the recess no casing on a first side of a plane which substantially tangentially cuts the strand and extends along the longitudinal axis and has a casing on a second side, which is opposite the first side, of the plane. This essentially means that the spacing between the plane and the center line, or the longitudinal axis, of the strand is between 0 and half the diameter of the strand.

In a preferred form of embodiment the support belt includes at least two strands which are arranged adjacent to one another. These strands arranged adjacent to one another thus form a flat band or the support belt. In particular, the at least two strands now have no casing partly above or below the plane which at least tangentially cuts the at least two strands and extends along the longitudinal axes or parallel thereto and have a casing above or below the plane. The spacing between the plane and the center lines or the longitudinal axes of the strands is between 0 and half the diameter of the strand.

The support belt constructed in this manner has in the sheathing a recess which extends over all strands and at least partly exposes the strands. The exposed strands can now be contacted in simple manner, since they are exposed for contact, but nevertheless remain embedded in the casing, whereby they are still defined with respect to their mutual position.

In a preferred form of embodiment the at least one strand consists at least partly of metal, for example iron or steel, and/or the at least one casing consists at least partly of an electrically insulating material, for example of textile fibers, of plastics material such as polyurethane, or of rubber.

In a further form of embodiment the casing is of multi-layered, at least double-layered, construction, wherein a casing part at the rear side is used substantially for positioning and holding the strand or the strands and a casing part of the front side fills strand intermediate spaces, and at the same time forms a structure appropriate to requirements, preferably longitudinal grooves. The recess can in this regard be arranged not only at the casing part at the rear side, but also at the casing part at the front side.

A connecting device for contacting a support belt relates to a support belt as described in the foregoing. The support belt includes at least one strand of a preferably electrically conductive material, for example steel, for absorbing the forces to be taken up by the support belt and a preferably electrically insulating casing which surrounds at least one strand. The connecting device for contacting the support belt includes at least one contact element which can be brought into contact with the at least one strand of the support belt, wherein the strand of the support belt can be contacted by the contact element in the region of a recess without piercing of the casing. The connecting device is constructed in such a manner that the at least one strand can be contacted by the at least one contact element at least partly perpendicularly to a longitudinal axis, which is formed by the center point of the cross-section, of the at least one strand without piercing of the casing. In particularly advantageous manner, in the case of this connecting device the contact element can be contacted with the strand without piercing of the casing by the contact element being required. A particularly precise orientation, checking and reliable contact-making of the strand by the contact element is thereby possible.

In a further variant the at least one contact element is of substantially rod-shaped construction, wherein one end of the at least one contact element, which is contactable with the at least one strand, is formed to be pointed or blunt. Alternatively, the contact element is constructed as a spring contact part. The spring contact part is advantageously also formed with a pointed or blunt contact end, wherein the contact end can be integrated integrally in the spring contact part or be mounted as a contact head on the spring contact part.

In the case of a contact element with a pointed end the point in general is employed for the purpose of the point penetrating the exposed strand. In the case of a contact element with a blunt end the contact element in general merely contacts the surface of the strand freed of casing without the contact element penetrating the strand.

Advantageously, the at least one contact element can be brought into contact with the at least one strand in such a way that the at least one contact element rests on the surface of the at least one strand and/or the at least one contact element penetrates the at least one strand.

In a further form of embodiment a pressure force can be applied by a resilient element, particularly a spring, to the at least one contact element for the purpose of contacting the at least one contact element, under the spring force, with the at least one strand. The application of a pressure force to the contact element by means of a resilient element has the advantage that compensation can be provided for production inaccuracies in or deformations of the support belt or the connecting device by the resilient element. It is thus ensured that a sufficient pressure force by which the contact element is brought into contact or held in contact with the strand is present on every occasion and thus a reliable and secure contact is given.

In particular, the at least one contact element is connected with a plug connection or a plug strip. This plug connection or plug strip is advantageously arranged at the connecting device. By means of a plug connection or plug strip of that kind, at which a counter-plug connection can be plugged, it is in practice possible to produce an electrical connection with a checking unit by means of a current conductor in a particularly simple manner. A complicated connection of lines is no longer required; it is merely necessary for the counter-plug connection to be introduced into the plug connection for producing the electrical connection. The checking unit can thereby be employed for permanent monitoring (static) of the support belt or the checking unit can be used for a selective limited time (temporary) in the elevator installation.

In a further embodiment the contact element is designed in such a manner that it electrically short-circuits together the strands exposed at an end of the support belt and makes possible a common connection of the support belt with the checking unit. It is thus possible to monitor a state of the support belt as explained, by way of example, in European Application EP 1275605. In this regard, wear of the support belt is detected when a strand or part of the strand has worked through the casing or the casing is abraded. This is detected in that the electrically conductive strand contacts a contact member, such as, for example, a deflecting roller, and thus the checking unit can detect, at least briefly, a grounding.

In another embodiment the at least one contact element is movable at least in part perpendicularly to the line.

In an enhancing form of embodiment the support belt is mechanically positively and/or frictionally fixable by the connecting device. In particular, the support belt can be fixed by shape-locking and force-locking couple by components of the connecting device, for example a base part and cover part or a base plate and cover plate as well as at least one transverse part.

In an additional embodiment the contact elements, particularly contact pins, can be moved manually or automatically, for example by means of a thread or a hydraulic or pneumatic drive, in the connecting device for contact-making with the strands.

A method of manufacturing a support belt, particularly for an elevator installation, comprises the following steps:

providing at least one, preferably electrically conductive, strand, enclosing the at least one strand by a preferably electrically insulating casing and removing the casing from the at least one strand, particularly only partly, perpendicularly to a longitudinal axis formed by a center point of a cross-section of the at least one strand, so that a recess arises in the support belt, which extends over an entire width of the support belt and exposes the strand in the region of this recess at least on one side of the support belt.

The subsequent removal of the casing from the strands has the advantage that the support belt can be manufactured economically in conventional mode and manner and only subsequently is the casing removed partially at the locally required sections of the support belt for the purpose of contacting the contact element with the strand.

Advantageously, the casing is removed from at least one strand partly above or below a plane which rests substantially tangentially against the strand or cuts the strand.

With advantage, the casing is removed mechanically, chemically or thermally. There are numerous possibilities for mechanical, chemical or thermal removal of the casing. This can be carried out mechanically by, for example, scraping, planning, filing, drilling, sawing, grinding, cutting or milling. In the case of chemical removal the casing is dissolved or etched away by, for example, appropriate solvents or acids. In the case of the thermal removal of the casing this is locally heated above its melting point so that this transfers into the liquid aggregate state and can thereby flow away. In addition, volatilization of the casing, for example chemically or thermally, is also possible.

An alternative embodiment of a system for contacting a support belt comprises a support belt with at least one strand of a preferably electrically conductive material, for example steel, for absorbing the forces to be accepted by the support belt and a preferably electrically insulating casing which encloses at least one strand. The system further comprises a connecting device for fixing the support belt by at least one movable contact element. This can be brought into contact with the at least one strand in a direction of a longitudinal axis, which is formed by a center point of a cross-section, of the at least one strand at an end of the support belt. The at least one contact element advantageously has in a first direction perpendicular to a longitudinal axis, which is formed by the center point of the cross-section, of the at least one strand a greater length than in a second direction which is perpendicular to the longitudinal axis and to the first direction. The length of the contact element in the first direction is, for example, 1 to 12 times greater than the length of the contact element in the second direction. The contact element is thus of flat construction. It is a contact blade. This has the advantage that during penetration of the contact blade into the end of the support belt in the direction of the first direction of the flat contact blade a large coverage with respect to the strands is present due to the substantial length of the blade in the first direction and consequently contact-making is virtually impossible. The orientation of the contact blade in the direction with respect to the support belt or the end of the second direction of the contact element is thus fundamentally critical for precise orientation of the contact blade with respect to the strand.

In particular, the at least one contact element is constructed as a contact blade, preferably with a point for contact-making with at the at least one strand. The contact blade has a point or cutting edge at a narrow side. The contact blade is at this point or cutting edge introduced into the support belt at the end of the support belt. In the case of a support belt constructed as a flat band and a contact blade the plane of the contact blade is generally perpendicular to the plane of the support belt constructed as a flat band. Thus, the orientation of the contact blade in the direction of a direction perpendicular to the plane of the contact blade is thus critical for precise contacting of the contact element, which is constructed as a contact blade, with the support belt. A direction oriented in the direction of the plane of the contact blade is thus not of critical importance for secure contacting of the strand by means of the contact element.

An elevator installation advantageously comprises a support belt as described in the foregoing and a connecting device, which is described in this application, for contacting a support belt.

DESCRIPTION OF THE DRAWINGS

A number of exemplifying embodiments of the invention and an exemplifying use in an elevator installation are described in more detail in the following with reference to the accompanying drawings. Parts with the same function are in this regard provided with the same reference numerals.

FIG. 2 shows a perspective view of the system according to FIG. 1, FIG. 3 shows a cross section of the system according to FIG. 1, FIG. 4 shows a perspective view of the system according to FIG. 1, with a plug strip, FIG. 5*a* shows a perspective view of a first contact pin, FIG. 5*b* shows a perspective view of a second contact pin, FIG. 5*c* shows a perspective view of a contact pin of FIG. 5*c* in another working position, FIG. 10 shows a perspective view of the system according to FIG. 9, FIG. 11 shows a cross-section of the system according to FIG. 9, FIG. 12 shows a schematic illustration of the system for contact-making with the support belt by a checking unit.

DETAILED DESCRIPTION OF THE INVENTION

Figure 1:
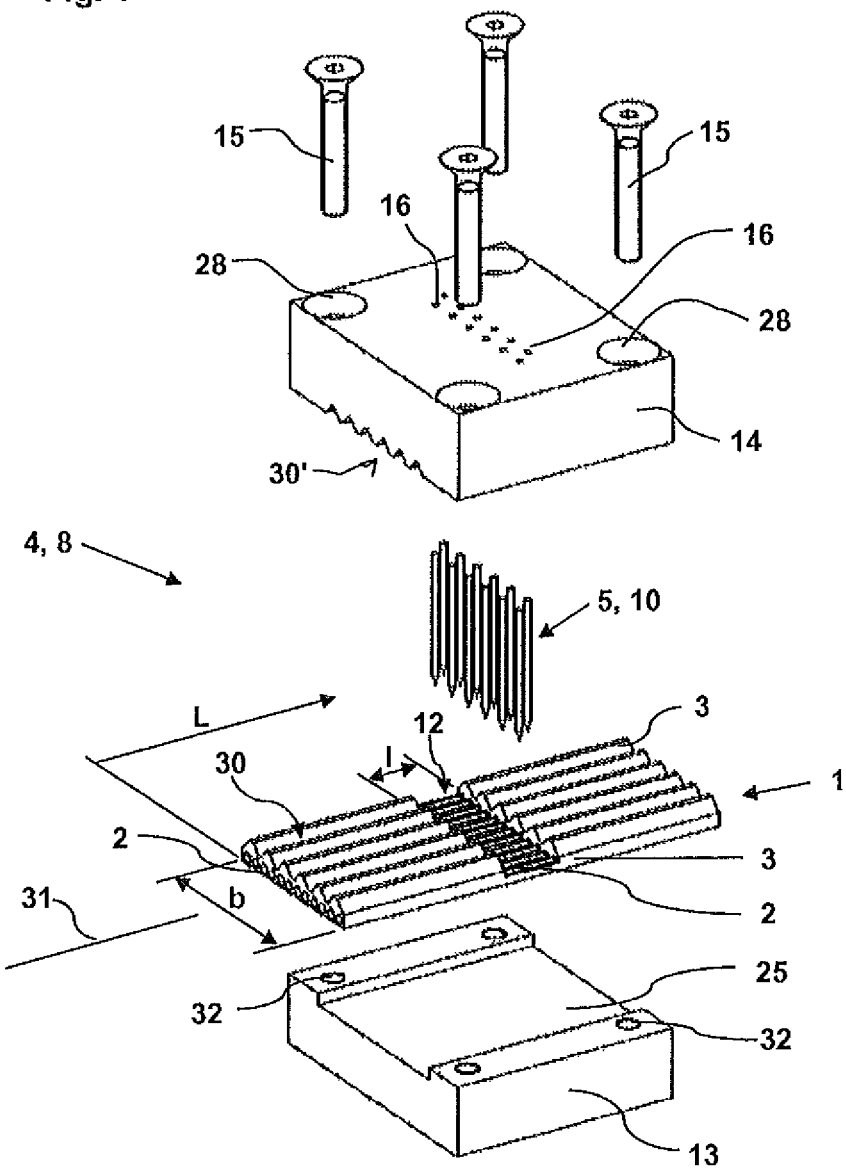
FIG. 1 shows an exploded illustration of a system for contact-making with support belt in a first form of embodiment.

A first system 8 for contacting a support belt 1 is illustrated in FIGS. 1 to 3. The support belt 1 to be contacted comprises, in the illustrated example, twelve strands 2 which consist of steel and are surrounded by a casing 3 (FIGS. 1 to 3). The casing 3 consists of electrically insulating synthetic material and has, at the upper side, longitudinal grooves 30 in the direction of the longitudinal axis 31 of the strands 2. The support belt 1 extends over a length L. The length L is dimensioned so as to be able to connect to a car of an elevator installation with a counterweight as well as to support and drive the same, as is illustrated by way of example in FIG. 13 and FIG. 14. The length L of the support belt is oriented to the travel path of the elevator car and the mode of suspension thereof. Typical lengths of support belts lie in the range of 15 to 120 meters, wherein greater lengths are also possible depending on a building height and corresponding travel paths. The support belt has, as considered in cross-section, a width b. Usual widths b of support belts lie in the range of 20 to 120 millimeters, wherein other dimensions are also possible. The support belt further has, at at least one of its ends or in the end region near the end of the support belt, a recess 12 which extends over the entire width b and over a limited, relatively small length section I of the support belt 1. In one exemplifying embodiment a dimension of the length section I is approximately 5 to 20 millimeters. The recess 12 is formed merely on a first side 7.1 of the support belt above a plane 7 (FIG. 3), which lies in the lines formed by the middle points of the cross-sections of the strands 2 or tangentially contacts or cuts the strands 2. Thus, the casing 3 is absent only in a part section perpendicular to the line which is formed by a center point of the cross-section of the strand 2. At the other side of the strands 2, i.e. below the plane 7 and on a second side 7.2 opposite the first side 7.1, the casing 3 is again present so that the strands 2 are partly embedded in this region by the casing 3.

The support belt 1 is contacted by way of a connecting device 4 by means of contact elements 5, which advantageously are movable (FIG. 3). The connecting device 4 comprises a base part 13 and a cover part 14 (FIGS. 1 to 3). The base part 13 is provided with a longitudinal groove 25, the width of which corresponds with the width b of the support belt 1. The support belt 1 can thus be mechanically positively held in the longitudinal groove 25 of the base part 13 in transverse direction. The cover part 14 advantageously consists of electrically insulating material such as, for example, plastics material, ceramic material, etc. The contact elements 5 insertable into the cover part 14 are thereby insulated from one another. The contact pins themselves can obviously also be provided with an outer insulating casing. In this regard, the cover part 14 can additionally be constructed from electrically conductive material. Screw-connection bores 28 without threads are arranged at the cover part 14. In addition, the cover part 14 has, at the underside, longitudinal grooves 30' which are formed to be complementary with the longitudinal grooves at the upper side of the support belt 1. The support belt 1 can thus be inserted at the underside into the longitudinal groove 25 of the base part 13 and, at the upper side of the support belt 1, the respective complementary mutually aligned longitudinal grooves 30', 30 of the cover part 14 and the support belt 1 interengage when the cover part 14 is arranged on or joined together with the base part 13 (FIGS. 2 and 3).

The cover part 14 is fastened to the base part 13 by means of four screws 15. The screws 15 are inserted into the screw-connection bores 28 without threads and the ends of the screws 15 are respectively introduced and screwed into threaded screw-connection bores 32 at the base part 13. The support belt 1 is thus connected by shape-locking and force-locking couple with the base part 13 and cover part 14 and fixed by means of the longitudinal groove 25 as well as the longitudinal grooves 30', 30 in the cover part 14 and at the upper side of the support belt 1. The casing consisting of synthetic material has resilient properties. The cross-sectional area of a cavity, which is formed by the longitudinal groove 25 and the longitudinal grooves 30' at the cover part 14, is smaller than the cross-sectional area of the support belt 1. The casing 3 is thereby resiliently compressed so that a frictional connection between the support belt 1 and the base part 13 and the cover part 14 is also present.

The connecting device 4 or the contact elements 5 thereof are precisely aligned by means of the longitudinal grooves 30' of the cover part 14 and the longitudinal grooves 30 of the support belt 1 with respect to the support belt 1 or the strands 2 embedded in the support belt.

By virtue of the resilient compression of the casing 3 a sealing of the actual contact point is additionally effected, whereby, for example, penetration of moisture at the contact point is avoided.

The cover part 14 is provided with twelve threaded bores 16, corresponding with the number of steel strands 2 employed, for the contact elements 5. The contact elements 5 are, as contact pins 10, formed with a point 11 (FIG. 5*a*). Formed at the outer side of the contact pin 10 is, for example, a thread (not illustrated). The contact pins 10 can thereby be screwed into the threaded bores 16 of the cover part 14 and brought into contact with the strands 2 of the support belt 1. The contacting of the twelve strands 2 with the twelve contact pins 10 can in that case be carried out in the manner that the points 11 of the contact pins 10 contact the strands 2 merely at the surface or contact side and thereby a contact and thus an electrical connection between the contact pins 10 and the strands 2 are produced. Beyond that, in the case of further screwing of the contact pins 10 into the threaded bores 16 the points 11 of the contact pins 10 can be pressed into the strands 2. Instead of points, use can also be made of differently shaped ends such as, for example, a flat support.

The contact pins 10 themselves can be constructed in various forms of embodiment. In one form of embodiment illustrated in FIG. 5*a* the contact pin 10 consists integrally of a metal rod, the end of which is shaped to form a flattened point 11. In the form of embodiment illustrated in FIG. 5*b* and FIG. 5*c* the contact pin 10 is multi-part. A rod 33 is displaceably arranged in a cylindrical tube 6. The point 11 is formed at the end of the rod 33. A spring 9 is arranged between the tube 6 and the rod 33, as illustrated in FIG. 5*b*. The spring 9 has in that case the effect of a pressure force being present in longitudinal direction between the tube 6 and the point 11. As a result, in this form of embodiment of the contact pin the tube 6, which is provided with an external thread (not illustrated) and which is arranged in the threaded bore 16 of the cover part 14, can be pressed by means of the spring 9 under a spring pressure force onto the strand 2 as schematically evident in FIG. 5*c*. This spring pressure force produces an improved contact between the point 11 and the strand 2 of the support belt 1.

Other forms of contact elements 5 can obviously also be used. Thus, a contact pin can be executed to be flat, such as a contact blade or contact cutting edge, or use can be made of oval or polygonal pins. The contact elements 5 can on occasion contact, as a common contact surface, all or a part of the strands 2 together if an electrical connection between individual or all strands is desired.

The connecting device for contacting the support belt 1 is additionally provided with a plug strip 38 in FIG. 4. The plug strip 38 in the illustrated example is mounted on the cover part 14 and electrically conductively connected with the respective contact pins 5, 10 (FIG. 2). A connection with the checking unit 23 (FIGS. 12 and 13) can thereby be produced in simple manner.

Figure 6:
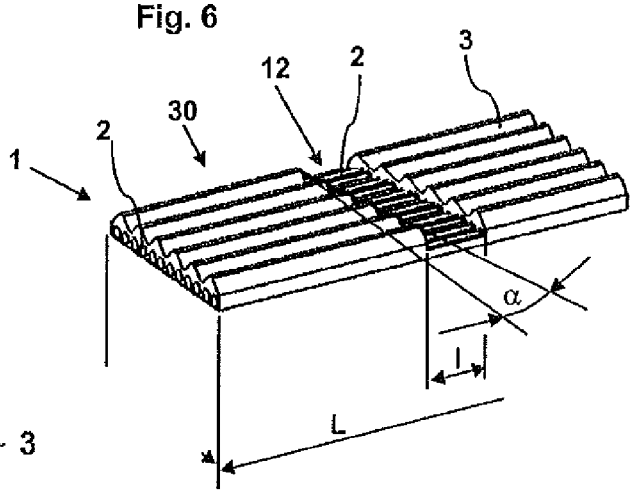
FIG. 6 shows an alternative embodiment of a support belt.
Figure 6A:
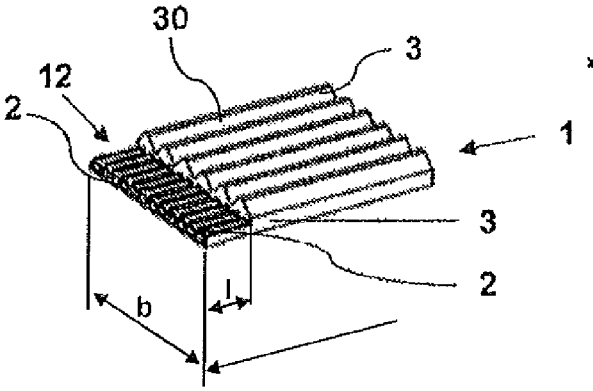
FIG. 6*a* shows another alternative embodiment of a support belt.
Figure 6B:
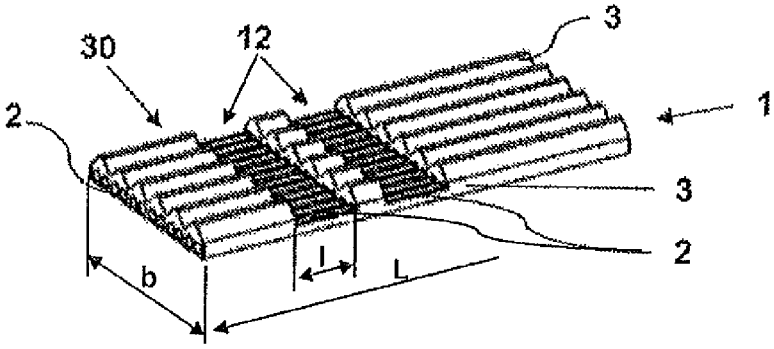
FIG. 6*b* shows a further alternative embodiment of a support belt.
Figure 6C:
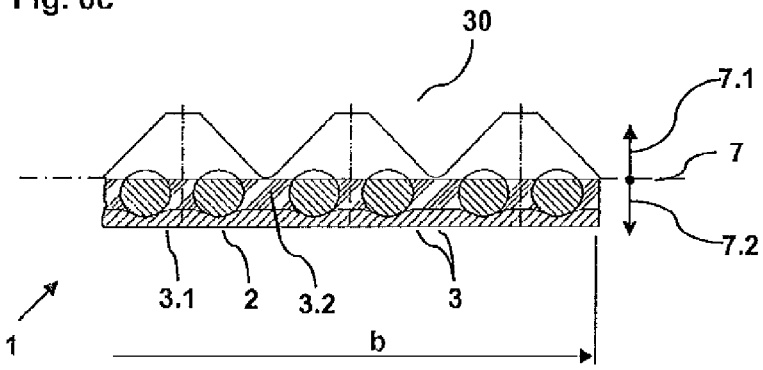
FIG. 6*c* shows an alternative exemplifying embodiment of a multi-layer support belt.

The recess 12 can, as apparent in FIG. 1, be formed at right angles transversely to the longitudinal orientation of the support belt 1. The recess 12 can alternatively be arranged at an angle a as illustrated in FIG. 6. Contact pins can thereby be distributed, for example, over a longer length. The arrangement of the recess is variable; thus, the recess 12 can also be distributed over several sections, as illustrated in FIG. 6*b*, or a recess 12 can be arranged at an end of the support belt 1, as illustrated in FIG. 6*a*. The support belt 1 illustrated in FIGS. 6 to 6*c* has in the region of the recess 12 on the first side 7.1 of the plane 7 (FIG. 6*c*), which in the illustrated example cuts the strand 2, no casing 3, but it again has a casing on the opposite, second side 7.2 of the plane 7. The recesses 12 are in this regard arranged near an end of the support means (FIGS. 6 and 6*b*) or directly at the end of the support means (FIG. 6*a*).

The support belt 1 or the strand 2 or the strands of the support belt can be enclosed by an integral casing 3. Alternatively, the sheathing 3 of the support belt 1 can, as apparent in FIG. 6*c* also be of multi-layer construction. The illustrated casing 3 is of double-layer construction. A casing part 3.1 at the rear side is used substantially for positioning and holding the strand or the strands 2 and a casing part 3.2 at the front side fills strand intermediate spaces and insulates the strands 2 relative to one another. At the same time the casing part 3.2 at the front side determines a structure appropriate to requirements. In the illustrated example this is the longitudinal grooves 30.

Figure 9:
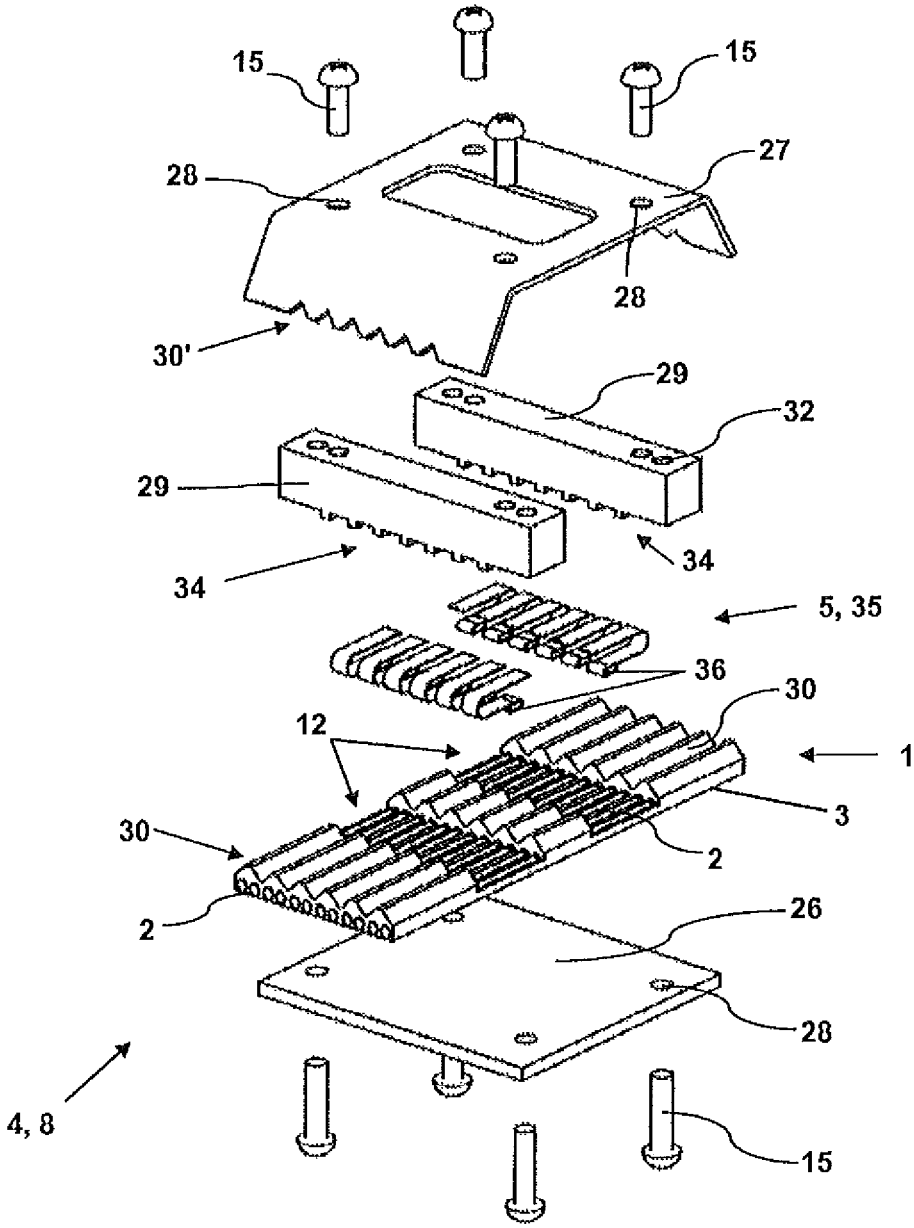
FIG. 9 shows an exploded illustration of a system for contact-making with a support belt in a further form of embodiment.

A further form of embodiment of the connecting device 4 for contacting the support belt 1 is illustrated in FIGS. 9 to 11. The connecting device 4 for contacting the strand 2 substantially consists of a base plate 26, a cover plate 27 and two transverse parts 29. A recess 12 of the casing 3 is formed at the support belt 1 analogously to the first form of embodiment. The recess 12 is arranged near the end of the support belt and it extends over the entire width of the support belt. In this example the recess 12 is further divided into two sections, whereby two recesses 12 are formed. Two threaded screw-connection bores 32 are respectively formed in the two transverse parts 29 at the two ends. The threaded screw-connection bores 32 of the transverse part 29 serve the purpose that four screws 15 are respectively screwed into these for fixing the cover plate 27 to the transverse part 29 and that by means of four further screws 15 the base plate 26 is screw-connected with the two transverse parts 29. The base plate 26 and the cover plate 27 are for this purpose each provided with four screw-connection bores 28. The two transverse parts 29 are in this regard arranged in correspondence with a spacing of the two recesses 12.

The cover plate 27 is formed in longitudinal section to be substantially U-shaped or with angled limbs. Longitudinal grooves 30' are formed at the end of the limbs of the U-shaped cross-section in analogous manner to the cover part 14 of the first form of embodiment (FIG. 9). In that case the longitudinal grooves 30' engage in the longitudinal grooves 30, which are of complementary construction, at the upper side of the support belt (FIGS. 10 and 11). The support belt I is thereby mechanically positively held in the connecting device 4 according to this further form of embodiment. Beyond that, the support belt I is also frictionally clamped in this form of embodiment, since in analogous manner to the first form of embodiment the cross-sectional free area between the base plate 26 and the longitudinal grooves 30' is smaller than the cross-sectional area of the support belt 1.

Clamping grooves 34 are present at the underside of the two transverse parts 29. The contact elements 5 are constructed as U-shaped spring contact parts 35. An upper limb of the spring contact parts 35 is clamped in a clamping groove 34 of the transverse part 29 and thus connected therewith and positioned.

A respective contact bead 36 is present at the end of the lower limb of each of the spring contact parts 35. The contact bead 36 is in that case contacted with the strand 2 of the support belt 1 (FIG. 11). The connecting device 4 has twelve spring contact parts 35 corresponding with the twelve strands 2 of the support belt 1. A spring contact part 35 is thus associated with each strand 2 of the support belt. By virtue of the spring force applied by the spring contact part 35 to the contact bead 36 the strand 2 is contacted by the contact bead 36 under a spring pressure force. Electrical lines and contact parts (not illustrated) are present in the transverse part 29 and produce an electrical connection of the spring contact part 35 in the clamping grooves 34 with continuing conductors.

The contact elements 5 or the spring contact part 35 can also be guided in this example on a common or several separate contact plates, whereby, for example, an electrical connection of all strands 2 or of sub-groups of the strands 2 can be produced in simple manner.

Beyond that, it is also possible to provide a plug connection or plug strip 38 at the cover plate 27 as illustrated in FIG. 4. The plug connection is in that case electrically connected in each instance with each individual spring contact part 35. When the connecting device 4 is connected with a checking unit 23 it is accordingly only necessary for a counter-plug connection to be introduced into the plug connection in order to produce the electrical contact (not illustrated).

The spring contact parts 35 are positioned above the transverse parts 29 at the cover plate 27. The cover plate 27 is in turn aligned by way of the longitudinal grooves 30' precisely with the longitudinal grooves 30 of the support belt 1, and the strands 2, with which contact is to be made, are similarly aligned within the support belt 1 or the associated sheathing precisely with the longitudinal grooves 30 of the support belt 1. Thus, in overall consideration the spring contact parts 35 are constrainedly aligned with the strands 2 and can be contacted in simple manner.

The illustrated spring contact parts 35 are provided with a contact bead 36. This is a substantially flat construction of a contact end which is integrated directly in the spring contact part 35. Alternatively, the contact end can be pointed or blunt, wherein a contact end of that kind can also be integrated integrally in the spring contact part 35 or mounted as a contact head on the spring contact part 35. Mounting in that manner can be carried out, for example, by means of riveting.

Figure 7:
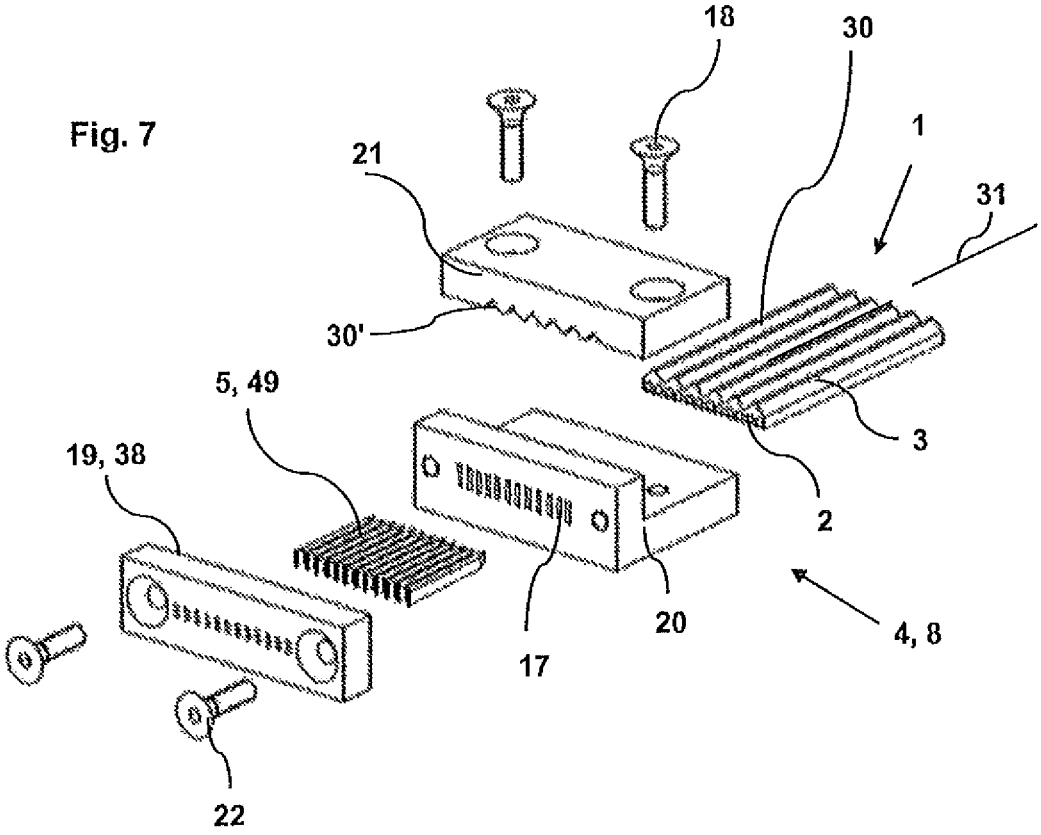
FIG. 7 shows an exploded illustration of a system for contact-making with a support belt in an alternative form of embodiment.
Figure 8:
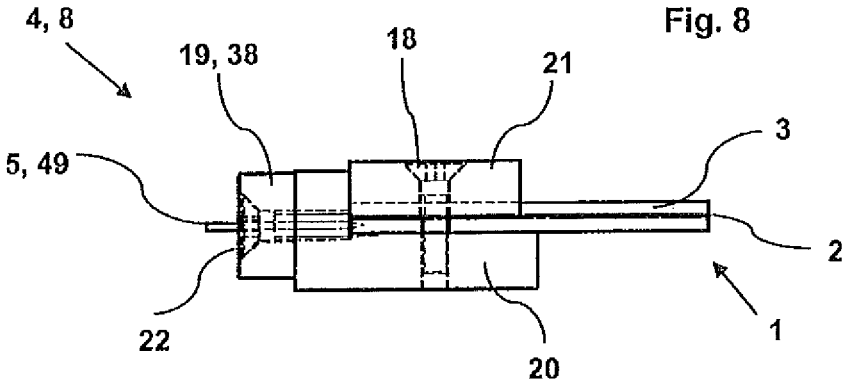
FIG. 8 shows a cross-section of the system according to FIG. 7.

A third form of embodiment of the connecting device 4 is illustrated in FIGS. 7 and 8. The connecting device 4 for making contact with the strands 2 comprises a base plate 20 and a clamping plate 21. The clamping plate 21 is provided with longitudinal grooves 30' which advantageously correspond with longitudinal grooves 30 of the support means 1. The clamping plate 21 is connected with the base plate 20 by means of clamping screws 18 and is firmly clamped with the support belt 1 in the end region thereof. The strands 2 integrated in the support means 1 are advantageously arranged in a fixed geometric association with the longitudinal grooves 30 of the support means 1. The base plate has a contact guide 17. Since the clamping plate 21 is precisely aligned by way of the longitudinal grooves 30' with the longitudinal grooves 30 of the support belt and the base plate 20 is in turn aligned with the clamping plate 21 by means of the arrangement of clamping screws 18 the contact guide 17 integrated in the base plate is as a direct consequence also precisely aligned with the strands 2 arranged in the support belt 1.

In this example the contact elements 5 are contact blades 49. The contact blades 49 are flat contact elements 5. The number of contact blades 49 is oriented to the number of strands 2 used. The contact blades 49 are oriented with their mutually facing flat sides adjacent to one another. These contact blades 49 are pushed in through the contact guide 17 and enable electrical contact-making with the strands 2 by points or cutting edges which are pressed into the end of the strand 2 and the adjacent region of the casing 3. A contact carrier 19 surrounds and holds the contact blades 49 in their pushed-in position. The contact carrier 29 is in the illustrated example fastened to the base plate 20 by means of retaining screws 22. The contact carrier 19 as well as the contact guide 17 are preferably made of electrically insulating material, for example plastics material or ceramic material. Alternatively, the contact blades 49 could obviously also be sheathed by an insulating material (not illustrated). Thus, the contact blades 49 can, for example, be provided with an insulating ceramic coating and merely end regions of the contact blades 49, which are intended for contact-making with the strand 2 or for connection of plug strips or cables, are constructed without a coating of that kind.

The contact carrier 19 can be constructed directly as a plug connection 38 or it can also be connected, for example by means of soldered connections and electrical lines (not illustrated), with other units, for example a checking unit 23. This connection can, in a particularly simple manner, also be constructed by means of the plug connection 38 arranged at or integrated in the contact carrier 19. It is then only necessary to plug a counter-plug connection into the plug connection 38.

The contact elements 5 can be arranged in a single row or multiple rows. In the examples according to FIGS. 1 to 3 and 9 to 11 double-row arrangements of contact elements 5 are shown. In this regard, the contact elements 5 are lined up offset relative to one another so that in each instance two adjacent strands 2 are contacted by contact elements 5 from different contact rows. This is advantageous, since a larger intermediate space or distance between the individual contact elements 5 accordingly arises.

In the example according to FIGS. 1 to 3 the contact elements 5 arranged in two rows engage in one recess 12 and in the example according to FIGS. 9 to 11 the contact elements 5 arranged in two rows engage in two recesses 12. This arrangement is exchangeable.

The expert can obviously constructionally modify and combine the illustrated embodiments. Thus, the expert can, for example, integrate the contact guide 17 directly in the clamping plate 21 or the expert can construct the contact pins 5 in all examples as flat, cutting-edge-shaped contact blades 49 which are pressed into the strands or construct the contact pins 5 in all examples as round contact pins 10 which are pressed into the strands. It is clear that in this regard the contact guide 17 and similarly the shape of the contact carrier 19 can be adapted to the form of the contact pins 5, 10, 49. If flat contact blades 49 are used, it can be useful, as illustrated in FIGS. 5*b* and 5*c*, for the flat blades to also be constructed with spring-loaded elements.

The clamping plate 21 can also be provided with additional transverse grooves for improved clamping of the support belt 1.

Obviously, as clarified in the explanations with respect to the examples according to FIGS. 1 to 3 and FIGS. 9 to 11, it is possible in all exemplifying embodiments for groups of contact elements 5 to be formed which electrically connect specific groups of strands 2 or all strands 2.

In an advantageous embodiment a system 8 for contacting the support belt 1 with the corresponding connecting device 4 and a surrounding support belt region is enclosed in a capsule (not shown) protecting against moisture or a protective mass such as, for example, silicon surrounds this system.

A checking unit 23 connected by means of current lines 24 with the system 8 (illustrated in simplified form) or connecting device 4 for contacting the support belt 1 at both ends of the support belt is illustrated in FIG. 12, wherein a connecting device is thus arranged at both ends of the support belt. The checking unit 23 is an electronic circuit which, because a respective system 8 is arranged at each of the two ends of the support belt 1, triggers a warning signal, for example an optical or acoustic signal, in the case of interruption of the check current conducted through the strands 2. The individual strands 2 can, depending on the respective form of wiring, be connected and evaluated individually or it is also possible to connect the individual strands 2 of the support belt 1 in series so that several strands can be checked and monitored by means of the check current.

A check current, for example, can be evaluated within an electronic circuit of the checking unit 23. Numerous other switching steps can be activated from this checking unit. For example, in the case of damage detected at one or more of the strands 2 an elevator installation can be automatically switched off or a warning signal for the users of the elevator installation can be triggered.

In a further embodiment of the checking unit 23 other signals such as ultrasound or light can, depending on the form of strands 2 used, be employed instead of electrical current.

Advantageously, the checking unit enables detection and localization of the material thickness and thus the state of wear, or fault locations or fractures, at the strands 2. Moreover, in an advantageous application the number, size and distribution of fractures in the strands 2 are also detected.

Figure 13:
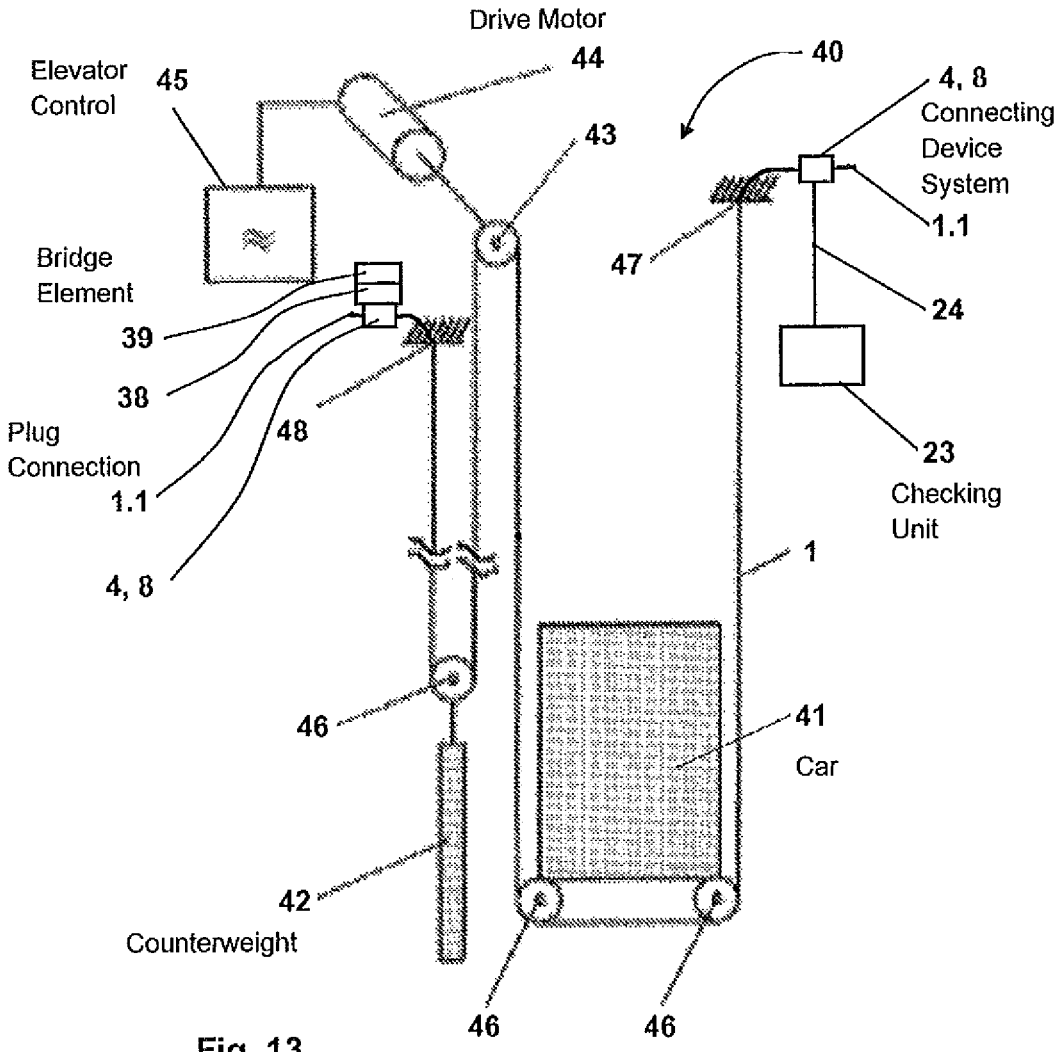
FIG. 13 shows a schematic illustration of an elevator installation with a system for contact-making with the support belt at the two ends by a checking unit.

In FIG. 13 the system 8 or the connecting device 4 for contacting the support belt 1 and the corresponding support belt 1 are installed in an elevator installation 40. The elevator installation 40 includes at least one elevator car 41, a counterweight 42 and the support belt 1 as well as a drive pulley 43 with an associated drive motor 44. The drive pulley 43 drives the support means 1 and thus moves the elevator car 41 and the counterweight 42 in opposite sense. The drive motor 44 is activated by an elevator control 45. The car 41 is designed to accept persons and/or goods and to transport them between floors of a building. The car 41 and the counterweight 42 are guided along guides. In the example, the car 41 and the counterweight 42 are connected by being suspended over the drive pulley 43. This means that the support belt 1 runs at a higher speed over the drive 43, 44 in correspondence with a suspension factor. In the example the suspension factor is 2:1.

The length L of the support belt 1 corresponds in this form of embodiment with approximately twice the maximum travel path of the car plus constructionally necessary additional lengths.

The support means or the support belt 1 is in this regard fastened by means of a first support means fastening 47 in the building. It is additionally guided over a support roller 46 of the car 41 to the drive pulley 43 and runs from there on to the counterweight 42, where it is in turn deflected by means of a support roller 46 at the counterweight and led to a second support means fastening 48. The support means fastenings 47, 48 introduce support forces of the support belt 1 into the building.

A free end 1.1 of the support belt 1 is provided with the system 8 or the connecting device 4 for contacting the support belt 1. In the example, systems 8 or connecting devices 4 of that kind are fastened to both ends of the support belt 1. These connecting devices 4 are arranged in the regions of the support means ends 1.1. These regions are no longer loaded by the supporting force in the support belt 1, since this supporting force has already been conducted beforehand into the building. In the illustrated example the connecting device 4 of the second support means fastening 48 is provided with a plug connection 38. Bridge elements 39 which electrically interconnect strands of the support belt 1 are connected on this plug connection 38. The connecting device 4 of the first support means fastening 47 arranged at the other end of the support means 1 is, in the example, connected by means of power lines 24 with the checking unit 23, which checking unit 23 carries out the required monitoring actions and brings into effect possible measures directly in the elevator control 45 or generates corresponding service demands. The connecting device 4 of the first support means fastening 47 can also be provided with a plug connection 38 which advantageously is directly integrated in the cover part 14 of the connecting device 4, as illustrated by way of example in FIG. 4. The checking unit 23 can thereby be directly connected with this connecting device 4 by use of a corresponding plug. Use of the checking unit 23 as a temporary checking unit or as a permanent checking unit is thereby possible. The illustrated elevator installation 40 is by way of example. Other suspension factors and arrangements are possible. The system 8 or the connecting device 4 for contacting the support belt 1 is then arranged in correspondence with the placing of the support means fastenings 47, 48. The checking unit 23 can also, as schematically shown in FIG. 12, contact both ends of the support belt 1.

Figure 14:
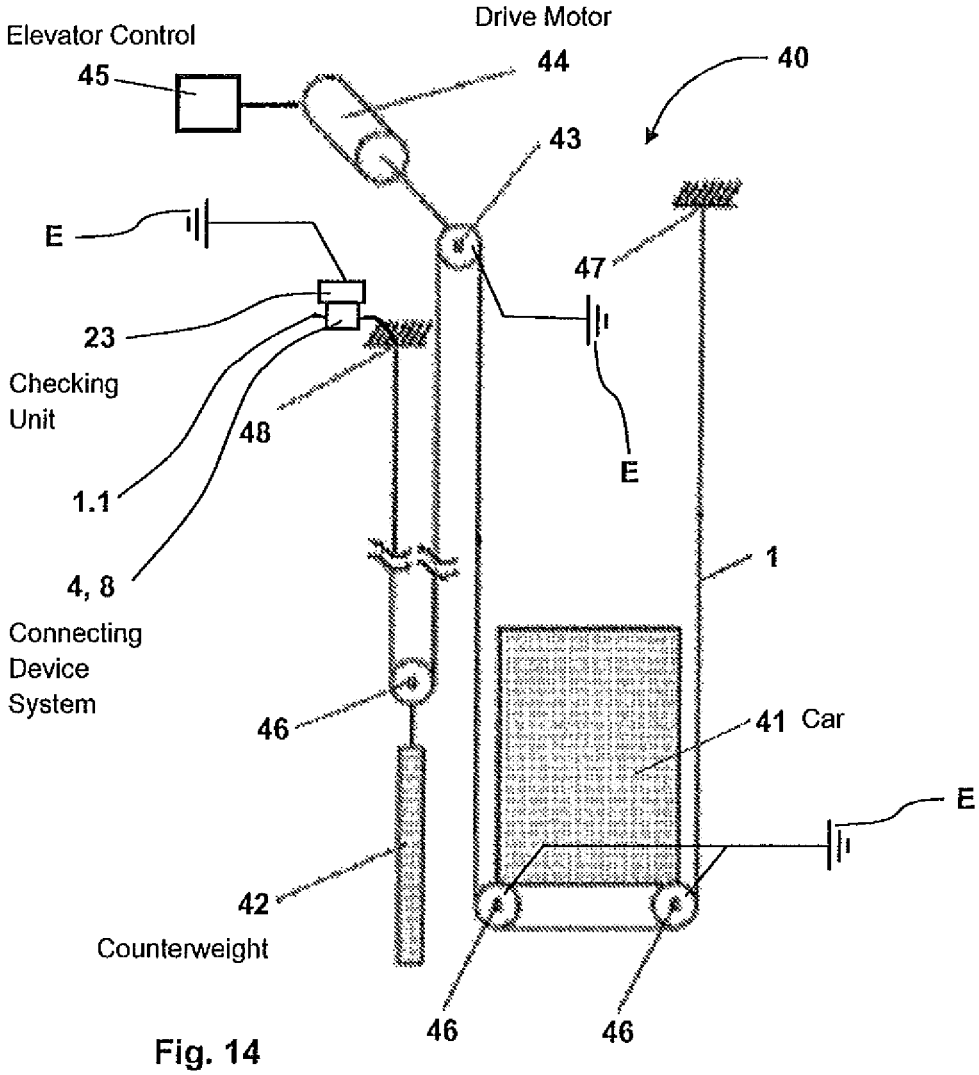
FIG. 14 shows a schematic illustration of an elevator installation with a system for contact-making with the support belt at one end by a checking unit.

Another system 8 or connecting device 4 for contacting the support belt 1, and the corresponding support belt 1, in an elevator installation are illustrated in FIG. 14. The elevator installation 40 is constructed basically as explained in FIG. 13.

However, by contrast with FIG. 13 only one free end 1.1 of the support belt 1 is provided with the system 8 or the connecting device 4 for contacting the support belt 1. The connecting device 4 includes all strands of the support belt 1. The checking unit 23 checks whether the support belt 1 or one of its electrically conductive strands has an electrically conductive contact with a deflecting roller 46 or drive pulley 43. For this purpose some of the deflecting rollers and drive pulley are grounded at E. Obviously, if required further contact points such as contact brushes or similar can be arranged along the support belt 1. If the checking unit detects a contact between strands 2 and one of the contact points or rollers 46, 43 a conclusion about the form of wear can be made on the basis of the duration of the contact, as explained in our application EP 1275605. In this exemplifying embodiment the opposite, second end of the support belt can be left without contact elements. It merely has to be fastened so that the strands have no electrical contact with surrounding elevator or grounded parts.

Figure 15:
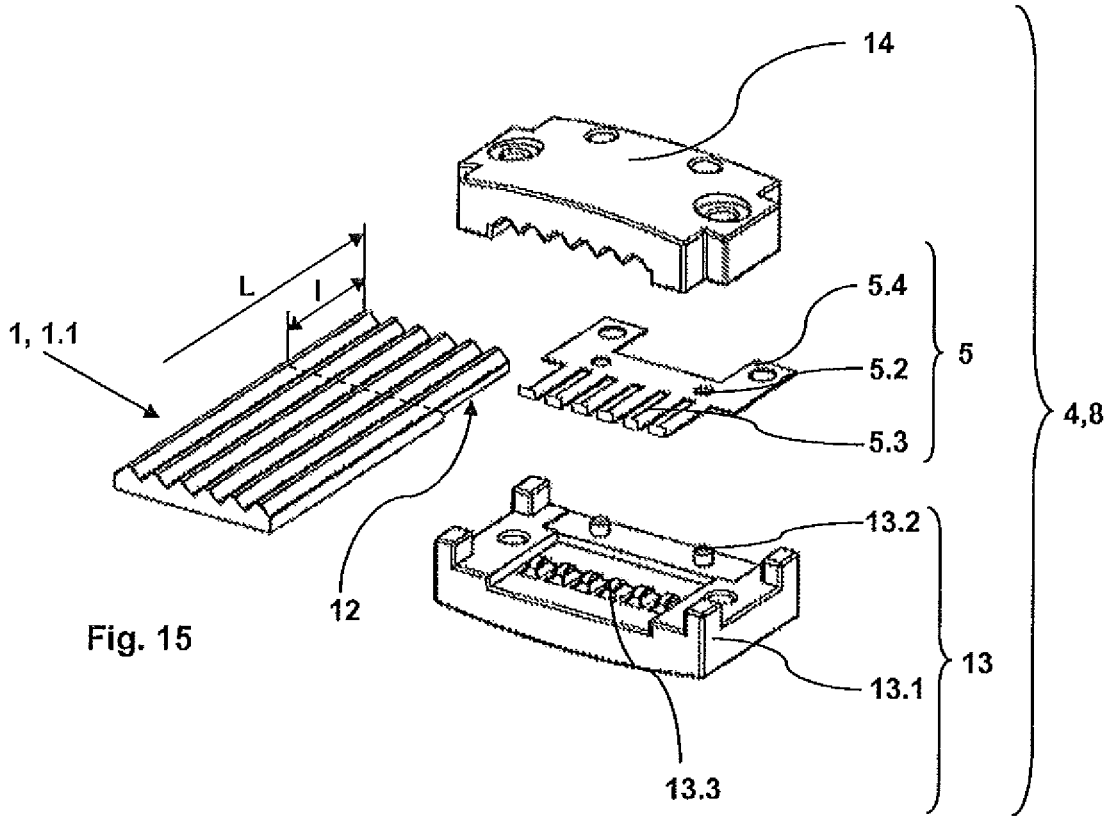
FIG. 15 shows an exploded illustration of a system for contact-making with a support belt with short-circuited strands and FIG. 16 shows a cross-section of the system according to FIG. 15.
Figure 16:
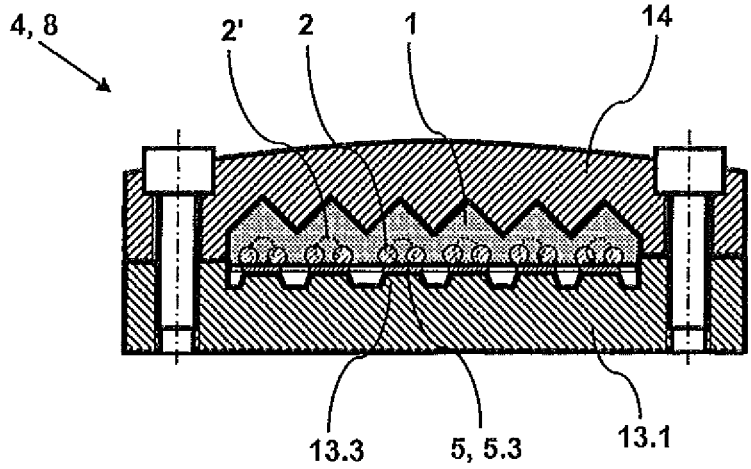

A further form of embodiment of the connecting device 4 such as is used in the elevator installation according to FIG. 14 is illustrated in FIGS. 15 and 16. The support belt 1 has at one end the recess 12 which extends on one side of the support belt 1 over the entire width thereof. The connecting device 4 includes the cover part 14, base part 13 and contact element 5. The base part 13 includes positioning aids 13.2 which enable precise positioning of the contact element 5 in the base part. Base part and cover part are held together by way of fastening elements. These fastening elements are selectably screw connections, spring clips or self-detenting connections directly integrated in the housing parts. In the assembled state (see FIG. 16) pressure points 13.3 which, for example, are arranged in the base part press contact tongues 5.3, which are led together in the contact element 5, against the strands 2 in the region of the recess 12 of the support belt 1. The cover element 14 has a suitable structure in order to produce, in co-operation with the base part 13 and the contact element 5 as well as the support belt 1, a contact of the contact tongues 5.3 with the strands 2. In the illustrated example, pressure points 13.3 each press a respective contact tongue 5.3 onto two strands 2. The contact tongues 5.3 are provided with bent-up portions at the ends. The contact tongue 5.3 is thus pressed with increased force into the strand 2 and by way of a shape of the contact tongue or of the base part a spring action is achieved which holds the contact tongue in resilient contact with the strands 2. If required, obviously also one pressure point per contact tongue and an individual strand can also be provided. This depends on, inter alia, a size of the strands. In the illustrated example according to FIG. 16 a strand diameter is approximately 1.5 to 2.0 millimeters. If instead of two strands 2 of that kind use were to be made of a single strand 2' with an appropriately larger diameter, the same construction of the connecting device 4 as illustrated in FIG. 16 by way of dashed lines could be used.

The connecting device 4 electrically combines all strands 2 and connecting tongues 5.4 allow a simple connection of the contact element 5 with the checking unit 23, as apparent in FIG. 14.

In this example, as well, the contact element 5 can obviously also be constructed so that, for example, merely groups of strands are connected together instead of short circuiting of all strands.

Considered overall, significant advantages are connected with the support belt 1 according to the invention and the system 8 or connecting device 4 according to the invention for contacting a support belt 1. The contacting of the strands 2 by means of contact elements 5 is substantially improved. In the case of contacting of the strands 2 perpendicularly to a longitudinal axis 31 of the strands it is no longer necessary to pierce the casing 3 of the support belt 1. Advantageously, as a result in the contact-making the disadvantageous consequences during piercing of the casing 3 by the contact elements 5 no longer occur.

The illustrated examples can be combined in many details. Thus, the spring contact parts 35 illustrated in the example according to FIGS. 9 to 11 can obviously usefully also be employed in the variants of solution of the examples of FIGS. 1 to 3, FIGS. 7 and 8 and FIGS. 15 and 16 instead of the contact pins 10 shown there. This is also possible in the converse sense. In addition, the illustrated recesses of FIGS.

6, 6*a* and 6*b* can be combined. The expert obviously also recognizes that the upper side and lower side of the support belt can be interchanged.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. A support belt for supporting a load in an elevator installation, the support belt extending a predetermined length between opposite ends and having a predetermined width, the support belt having a first side and a second side opposite the first side, which sides extend over the width of the support belt, the support belt comprising:

at least one strand for absorbing a portion of a load borne by the support belt, said one strand extending over the length of the support belt;

a casing formed of electrically insulating material and enclosing said one strand; and wherein the support belt has formed therein at at least one of the opposite ends a recess which extends on the first side over the entire width and over a predetermined length section of the support belt, said casing being removed at said recess and said one strand being exposed at said recess on the first side of the support belt wherein at said recess the support belt has said casing removed on the first side to a plane resting substantially tangentially against said one strand or cutting said one strand, but has said casing remaining on the second side to said plane.

2. The support belt according to claim 1 wherein said one strand is formed of an electrically conductive material, and said electrically insulating casing is formed of at least one of textile fibers, plastics material and rubber.

3. The support belt according to claim 2 wherein said one strand and at least another strand are arranged adjacent to one another and said casing encloses said one strand and said another strand in common and electrically insulates them from one another and said one strand and said another strand are exposed at said recess.

4. The support belt according to claim 1 wherein said casing is of double-layer construction, wherein a first casing part at the second side positions said one strand during a manufacturing process and a second casing part at the first side covers said one stand and forms longitudinal grooves.

5. The support belt according to claim 1 wherein said recess is positioned at one of the opposite ends of the support belt or between two sections of said casing.

6. The support belt according to claim 1 wherein said recess extends over the entire width of the support belt at a predetermined angle of less than 90° relative a longitudinal axis of the support belt.

7. A connecting device for making contact with the support belt according to claim 1 including a contact element in contact with said one strand of the support belt, wherein said one strand contacts said contact element at said recess without said contact element piercing said casing.

8. The connecting device according to claim 7 wherein said contact element is of rod-shaped construction with a pointed or blunt contact end, said pointed contact end partly penetrating said one strand and said blunt contact end contacting a surface of said one strand.

9. The connecting device according to claim 8 wherein said contact element includes a rod disposed in a cylindrical tube, said contact end being formed on an end of said rod extending from said tube and a spring positioned between said tube and said contact end for pressing said contact end against said one strand.

10. The connecting device according to claim 7 wherein said contact element is formed as a U-shaped spring contact part with a contact bead for contacting a surface of said one strand.

11. The connecting device according to claim 7 wherein the support belt includes a plurality of electrically conductive strands extending over the length of the support belt and said contact element either electrically contact each of said strands individually or electrically short-circuits said strands.

12. The connecting device according to claim 7 wherein said contact element is pressured into contact with said one stand by a spring or by a resilient construction of said contact element.

13. The connecting device according to claim 7 having a positioning structure of a first plurality of longitudinal grooves co-operating with a second plurality of longitudinal grooves formed in the support belt for alignment of the connecting device with the support belt.

14. The connecting device according to claim 7 including a plug connection releasably connected to said connecting device for electrically connecting said contact element to at least one of a checking unit and an elevator control.

15. A method of manufacturing a support belt for supporting a load in an elevator installation, comprising the steps of:

providing at least one strand;

enclosing the one strand in a casing; and forming a recess in the casing over an entire width of the support belt so that the one strand is exposed in the recess at least on a first side of the support belt wherein at said recess the support belt has said casing removed on the first side to a plane resting substantially tangentially against said one strand or cutting said one strand, but has said casing remaining on the second side to said plane.

16. The method according to claim 15 wherein the step of forming is performed by at least one of mechanically, chemically and thermally removing a portion of the casing.

17. An elevator installation having an elevator car and a counterweight, which are connected, supported and driven by a support belt, comprising:

at least one strand for absorbing a portion of a load borne by the support belt, said one strand extending over a length of the support belt;

a casing of electrically insulating material enclosing said one strand, the support belt having opposite ends and first and second opposed sides with a recess which extends on the first side over an entire width of the support belt and over a predetermined length section of the support belt, said casing being removed at said recess and said one strand being exposed at said recess on the first side of the support belt wherein at said recess the support belt has said casing removed on the first side to a plane resting substantially tangentially against said one strand or cutting said one strand, but has said casing remaining on the second side to said plane; and a connecting device including a contact element in contact with said one strand of the support belt, wherein said one strand contacts said contact element at said recess without said contact element piercing said casing.

* * * * *